US005775218A

United States Patent [19]

Zimmer

[11] Patent Number: 5,775,218

[45] Date of Patent: Jul. 7, 1998

[54] SELF-CLEANING APPARATUS FOR THE APPLICATION OF A SUBSTANCE ON A FABRIC TRAIN AND PROCESS OF OPERATION THEREOF

[76] Inventor: Johannes Zimmer, Ebentalerstrasse 133, A-9020 Klagenfurt, Austria

[21] Appl. No.: 532,634

[22] PCT Filed: Feb. 13, 1995

[86] PCT No.: PCT/AT95/00031

§ 371 Date: Dec. 11, 1995

§ 102(e) Date: Dec. 11, 1995

[87] PCT Pub. No.: WO95/21746

PCT Pub. Date: Aug. 17, 1995

[30] Foreign Application Priority Data

| | | | |
|---|---|---|---|
| Feb. 12, 1994 | [EP] | European Pat. Off. | 9400419 |
| Dec. 12, 1994 | [AT] | Austria | 2304/94 |
| Dec. 12, 1994 | [AT] | Austria | 2307/94 |

[51] Int. Cl.[6] ..... B41L 13/00

[52] U.S. Cl. ..... 101/120; 101/425

[58] Field of Search ..... 101/114, 116, 101/119, 120, 129, 423, 424, 425, 348, 349

[56] References Cited

U.S. PATENT DOCUMENTS

| | | | |
|---|---|---|---|
| 3,986,450 | 10/1976 | Zimmer | 101/425 |
| 4,436,032 | 3/1984 | Van Ouwerkerk | 101/425 |

FOREIGN PATENT DOCUMENTS

| | | |
|---|---|---|
| 284 169 | 9/1970 | Austria . |
| 338 209 | 8/1977 | Austria . |
| 360 949 | 2/1981 | Austria . |
| 376 612 | 12/1984 | Austria . |
| 393 246 | 9/1991 | Austria . |
| 0 056 630 | 7/1982 | European Pat. Off. . |
| 0 147 536 | 7/1985 | European Pat. Off. . |
| 0 277 481 | 8/1988 | European Pat. Off. . |
| 0 494 339 | 7/1992 | European Pat. Off. . |
| 24 52 778 | 5/1975 | Germany . |
| 556 236 | 11/1974 | Switzerland . |
| 571 951 | 1/1976 | Switzerland . |

*Primary Examiner*—Ren Yan

*Attorney, Agent, or Firm*—Wenderoth, Lind & Ponack, L.L.P.

[57] ABSTRACT

A template and an application device of an apparatus for application of a substance to a fabric train are cleaned either in situ within the application apparatus or after being withdrawn as a unit and supported in a separate washing device. Cleaning fluid is supplied to the application device at an inlet thereof that is the same that receives substance to be applied to the fabric train. The cleaning fluid is discharged from the application device through a plurality of discharge holes having respective discharge axes. The discharge holes are arranged with the discharge axes extending parallel to each other and spaced in a direction parallel to the template at intervals of 5–20 mm between adjacent axes. The discharge holes are spaced from the template such that the substance or cleaning fluid passes from the discharge holes directly to the template. The discharge holes have a total cross sectional area that is at least twice a cross sectional area of the inlet to the application device.

16 Claims, 7 Drawing Sheets

SELF-CLEANING APPARATUS FOR THE APPLICATION OF A SUBSTANCE ON A FABRIC TRAIN AND PROCESS OF OPERATION THEREOF

BACKGROUND OF THE INVENTION

The market demands that the textile printer manage an increasingly larger variety of print applications—more variety of design and more variety of color combinations per design—in smaller and smaller application sizes while still increasing the economic viability. With these requirements comes the demand to effectively shorten (effective in a productive sense) the ever increasing time required for rigging and cleaning. At the present tine, the purely printing production time in many printing houses is already less than 50% of the entire run time (work time), which is unacceptable.

Considering this objective, application equipment has been suggested which allow cleaning of the application equipment itself and if need be the round template surrounding it on the printing machine. Also, with such equipment, the possibility must be provided to transport a template to a washing machine installed next to the printing machine and clean it there if the color is to be changed in just one template. The invention thus pertains, similar to EP 0 494 339 A1, to an apparatus for the application of a substance onto a fabric train, particularly for textile printing, by means of round templates in which the application device includes equipment for the cleaning of the application equipment itself and of the template if necessary and in which the feed of the substance and of cleaning fluid proceeds through a tube parallel to the template and through a multitude of lateral exit holes. Between the exit holes and the point of application, or cleaning zone, no portions touching or carrying the applied substance or the cleaning fluid are located, so that the substance or cleaning fluid flows directly from the exit holes to the interior of the template. The equipment shown by EP 0 494 339 A1 avoids a disadvantage of the older equipment according to EP 0 277 481 B1, in which baffles are arranged for the distribution of a substance coming from the lateral exit holes, which bring into question the mandatory self-cleaning of the application equipment in the sense of the general objective. In order to achieve a uniform distribution of the substance to some extent over the width of the fabric train to be printed without such guiding and distributing surfaces, the substance is fed to the exit holes, whose typical spacing is 50–100 mm, under high pressure according to the state of technology. In order to build up an effective pressure over the entire exit width, the exit openings are small. The pressure must be high enough so that the substance does not exit in a closed stream per EP 0 494 339 A1, but rather is sprayed in a fan shape.

SUMMARY OF THE INVENTION

The invention starts with the reasoning that the spraying of the substance and of the cleaning fluid under high pressure is not optimal for either the application process or for the cleaning process. The goal, first strived for by the invention, of retaining templates and application equipment in a combined constructed state is only achievable through an optimization of the cleaning process if cleaning is done by choice in a specialized washing machine.

According to the invention, the application equipment is to be retrofitted such that the normally viscous applied substance (printing paste, printing colors) can flow (not spray) nearly pressureless in a slowly streaming condition at greatly reduced pressure compared to the inlet pressure in a practically closed stream of uniform thickness distributed evenly over the application width at the point of application. Since low pressure is used in the application procedure the pressure at cleaning can be significantly increased whereby water or another non-viscous cleaning material reaches the round template interior wall with high velocity straight in the axial direction of the exit holes and flushes it. The template openings are permeated by the cleaning fluid which makes a certain cleaning of the template exterior possible.

The desired method of functioning is accomplished according to the invention by making the distances between axes of the exit holes 5–20 mm, advantageously 5–15 mm, independent of the length of the application equipment, and by making the sum of the cross sectional area of all exit holes at least twice as large as the area of the inlet port in the tube body. To supply the substance to the point of application immediately up to a back-fill element, a new path according to the invention is taken in more than one respect: the substance fed/guided is divided many times so effectively through a flow dividing-channel body constructed in a new fashion in the application equipment, such that an exit separation of only 20 nun at the most is brought about (preferred 5–15 mm); this is applicable to all, i.e. independent of all existing application widths in practice which lately, according to the invention, can be as high as 10 meters. The application equipment according to the invention becomes technically and economically interesting also for applications without round templates or screening cylinders. In what follows, the sum of the substance discharge cross sectional area is a multiple—at least double—of the inlet flow cross sectional area, whereby the outlet pressure is reduced to nearly zero with reliably achievable discharge uniformity. The spraying out, or wide spray associated with the previous state of technology does not occur according to the invention.

Use of the equipment according to the invention opens interesting new technical and economic possibilities. Following the general objective described above, the cleaning process is included in the requirements of the print production as it corresponds otherwise to the current view of this production process in its entirety: application, cleaning, and fit-up requirements must be viewed as a technical-economic unit. This invention must also be seen in this sense. In accordance with the invention, the possibility is presented, in which the cleaning process is carried out at the printing machine depending on the respective printing method or a transfer is made to a cleaning machine constructed and set up close to the printing machine according to the invention.

The invention pertains essentially to two pieces of equipment, which can be connected into a single unit in the previous sense. The foundation is the application equipment per the invention, which is also a cleaning device and indeed as well a self cleaning unit as well as a template cleaning unit; at least for round template interior cleaning, which is the more difficult. The first piece of equipment is an application unit, which at the same time is a cleaning unit for the substance delivery equipment, for the back-fill element and for the round template and which can be employed in this multiple function selectively in the printing machine or in the cleaning machine which constitutes the second piece of equipment.

It is characteristic of the process of the invention that the cleaning procedure always covers the entire functioning unit of the printing process, i.e. application device (back-fill device) and round template together; this independent of whether the cleaning takes place in the printing machine or outside of the printing machine. The choice is free to the operator. If only 1–2 printing units (application unit together with template) must be cleaned during a color change within the same design, the operator will prefer the separate washing machine; if all printing equipment of a printing machine must be cleaned (design change), the operator will prefer to clean within the printing machine. Still, it is possible to clean the majority of the printing equipment inside the printing machine, while at the same time cleaning a few in the separate washing machine. Another criterion for such selection is the flow-through characteristics of the template. Templates which print a relatively large pattern coverage—somewhat more than 10% of the entire surface—can be cleaned advantageously inside the printing machine; if the color flow-through consists of less than 10%, however, separate cleaning must be preferred since the cleaning is carried out in the washing machine per the invention in an inclined position in which the water (the cleaning fluid) can run off better, i.e. faster, than in the printing machine. The choice of one of the two cleaning types is therefore characteristic of the process as is also the simultaneous use of both cleaning types side by side. Both cleaning types are made possible by the application equipment constructed per the invention, and indeed particularly by means of the substance delivery equipment.

Significant concerning the invention are thus substance delivery without the presence of any equipment outer surfaces in contact with the substance, suitability of the substance delivery equipment for the cleaning of the application equipment with considerably reduced usage of cleaning fluid (water) compared to previously (characteristic of water-conserving, complete self-cleaning), suitability to self-cleaning without tear-down (removal) of the application equipment from the round template which contains it and at the same time suitability as cleaning equipment for the round template as well, particularly for the inner surface and the substance flow-through openings of the round template. The advantage of the invention is that there is no requirement for additional fit-up of the printing machine with cost-intensive vacuum equipment since the small amount of cleaning fluid flows to a conveyor through the template openings and is fed into the existing wash-water collection tank of the printing machine. Should only individual printing equipment be cleaned and changed out during a change of only a single color of a multi-colored pattern, in which the other colors remain unchanged, and/or should printing equipment with such templates that have only a very small total flow-through be cleaned, since then only small pattern fractions are printed, the second process provided per the invention comes into consideration; that is, cleaning of the entire printing equipment—application/back-fill equipment and template together—in the washing machine constructed per the invention. If round templates are removed from the production equipment for cleaning, a separation of the application equipment arranged in the round template from the template has occurred up until now without exception and a special cleaning of template and application equipment was done. The template was placed in a unit, as is described in European Patent application 0 418 672 (Johannes Zimmer). Rotating cylinder brushes clean the outside of the template while a spray tube placed through the template along its entire length introduces cleaning fluid. The invention attains in contrast a substantial simplification, in which provisions are made for the removal of the round template together with the application equipment arranged in it and these are placed in the washing machine. The addition of cleaning fluid to the round template in the washing machine is carried out through the application equipment.

By using the process per the invention for self-cleaning application equipment, the special cleaning of the application equipment is eliminated. It is already cleaned by fulfilling its function in the process of cleaning the template. If the application equipment includes a magnetically attachable back-fill roll which lies on the application equipment under the influence of permanent magnets, the cleaning of this back-fill roll can also be accomplished in the course of the unitized washing process per the invention. Whether or not the invention is usable with the highest effect in self-cleaning application equipment, it could still be used in application equipment in which the cleaning fluid is fed independently of the distribution system for the applied substance. Particularly with self-cleaning application equipment, such an additional feed system in the application equipment is sensible. This has the goal above all of intensively cleaning the inside of the template and a provided back-fill roll as necessary.

The general cleaning of round templates and application equipment represents the end phase of a total process consisting of application and cleaning. The task is particularly then, to manifest the transfer between these two steps optimally. The feed of cleaning fluid through the application equipment is in this sense only then expedient if previously the application substance has been already largely removed from the application equipment. In the sense of a relinquishment to one particular equipment for cleaning of the application equipment, a preferred variation of the process per the invention is provided in which pumps feeding the applied substance during the production process draw off the excess applied substance in the reverse functioning direction before the feeding of cleaning fluid before the washing procedure takes place.

A surprising advantage of the invention lies in that the better the application unit is suited for template cleaning, the correspondingly better it is suited for its actual production task, namely the uniform width-distributed delivery of substance to a point of application, within the scope of the process per the invention. In order to carry out the process per the invention, it is preferable to use an application unit in which the distribution system of the application equipment ends in a row of tubular nozzles, whose separation spacing is 5–20 mm independent of the length of the application unit. With this, it is particularly characteristic of the invention as well as for application and for subsequent cleaning, that between the nozzles and the point of application, or cleaning zone, no parts carrying or in contact with the applied substance or cleaning fluid are installed so that the substance or cleaning fluid flows directly in free fall out of the nozzles to the inside of the template. The use of a magnetically attached back-fill roll is suited perfectly to the objective first proposed here of optimizing the application process in its entirety, that is to keep track of the fit-up, tear-down and retrofit, and cleaning of the application equipment itself and that of the template simultaneously with the functioning of the application equipment in the production process. The back-fill roll moving the substance through the template in the production process assists with its continuous or intermittent operation during the cleaning process in the inner and outer cleaning of the round template and is thereby itself cleaned.

BRIEF DESCRIPTION OF THE DRAWINGS

Other particulars of the invention are illustrated in the accompanying drawings, wherein.

DETAILED DESCRIPTION OF THE INVENTION

Figure 1A:
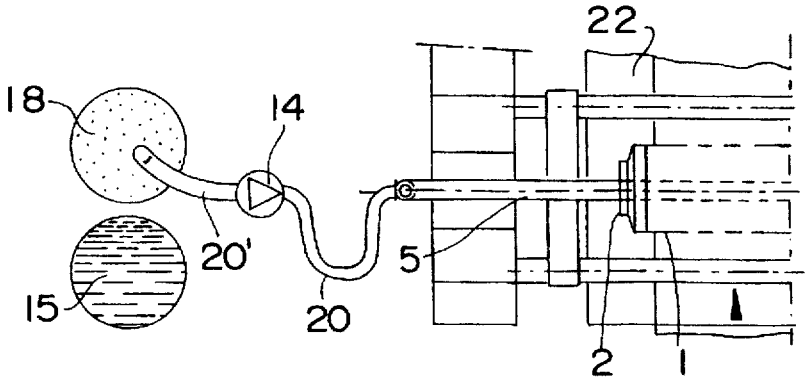
FIGS. 1*a*–1*e* are schematic illustrations illustrating various steps in a process according to the present invention.

FIG. 1*a* shows the primary function of an application unit 5 is to apply a substance 18 onto a fabric moving by means of a printer's blanket 22 through a round or cylindrical template 1. The round template 1 is stretched over rotating mounted end rings 2 (not represented in detail). The substance 18 is fed by a pump 14, preferably a tubular pump, through hose sections 20' and 20 of the application unit 5 and distributed uniformly therefrom. That the application unit 5 is suited for the production process in the same way as for individual cleaning and cleaning of the template, is explained in more detail in connection with FIGS. 2*a*–5*b*.

Figure 1B:
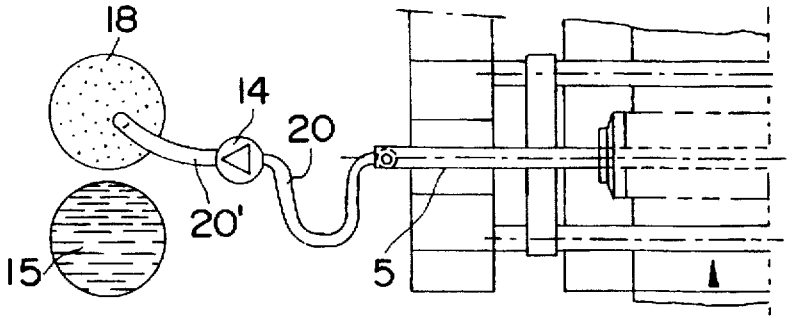

If round template 1 and application unit 5 are cleaned during lengthy or temporary interruption of the production process, the effective direction of the pump 14 is first of all, as shown in FIG. 1*b*, reversed and the substance remaining in the application unit 5 is added to the substance supply 18. In order to avoid the downward dripping of the substance at the end of or during an interruption of the printing operation which occurs after lifting the printing equipment by slow continued turning of the template upward on the inner wall, just the magnetic field is shut off first per the invention prior to lifting. With this back-fill roll 8 is moved from the template from the solid line position of FIG. 1*b* to the dashed line position. If, however, the template turns at least one complete rotation, wall 11 acts as a slotted wiper which spreads the substance into a thick layer corresponding to the separation from the template in a slotted wiper layering fashion. A comparable layer of this type then no longer drips. One can then either continue production after the interruption or wash in the printing machine or in the separate washing machine without having substance drip from the outer side of the application unit 5 which then must later be removed again with a separate cleaning procedure. This is an important measure manifesting the main idea of the invention.

Figure 1C:
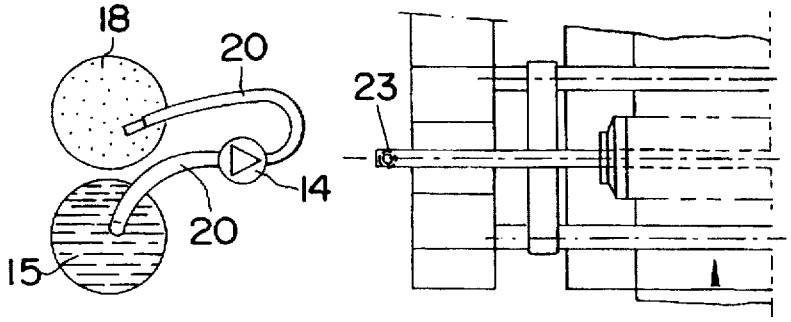

As an intermediate step, water can be sucked from container 15 as shown in FIG. 1*c* after loosening tube connection 23, whereby the applied substance is pushed from the tube section 20, from the pump 14 and from the large portion of the tube section 20' and returned to the supply 18. It must be ensured that this process step proceeds quickly enough so that either no or only minimal cleaning fluid (water) finds its way into the substance supply 18. This procedure (cleaning step) can be optimized per the invention by employing a compressible stopper, for example made of foam rubber, in the take-up of the suction line 20'. This stopper intensifies the cleaning effect of the flowing fluid similar to a sponge. The preferred tubular pump per the invention is a prerequisite for the use of this invention manifesting, total-cleaning-process-optimizing measure. The cleaning object (sponge or the like) passes through and cleans the tubular pump as well therewith per the invention and separates at the same time the substance from the subsequently flowing medium.

Figure 1D:
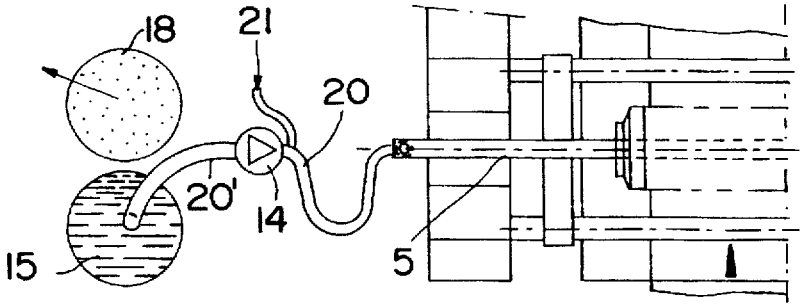
Figure 1E:
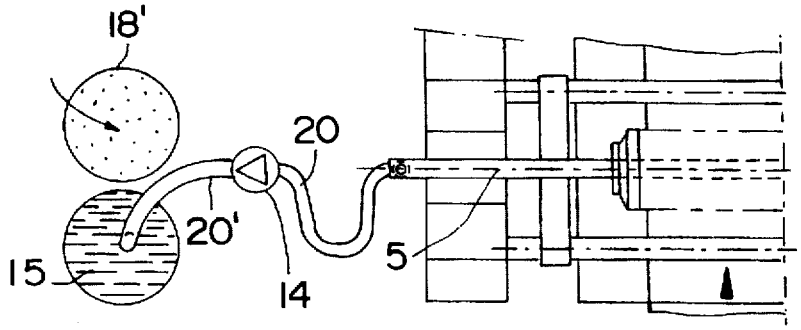

FIG. 1*d* shows how a self-cleaning application unit 5 is cleaned without removing it from the production equipment. Water 15 can be fed through the pump 14 and through the tube sections 20 and 20'. This process can be aided with compressed air as indicated by arrow 21. While the substance supply 18 is replaced by a coloring supply 18', the cleaning fluid can be fed from the application unit 5 back into the water container 15 or into a wastewater channel (FIG. 1*e*).

Figure 2A:
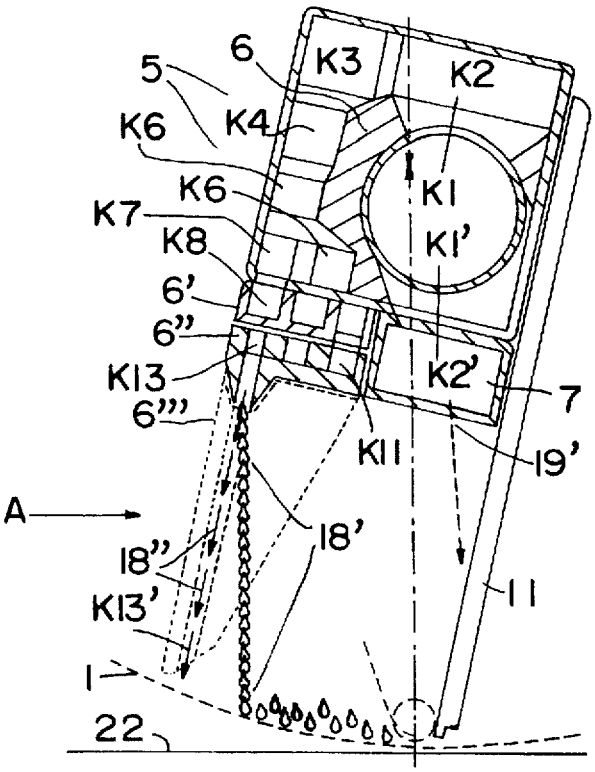
FIG. 2*a* is a cross section through an application device according to the invention.

FIG. 2*a* shows in schematic representation total cross section through an application unit 5 constructed per the invention. It is to be understood that the flow channels located spatially behind one another seen in the direction of the longitudinal axis and channel connections in the illustrated plane are arranged next to one another. In this illustration, only that cross sectional portion of a flow distribution channel body 6 (distribution system 6) in which no hollow space exists on the entire length of the equipment is shown shaded. Object 6 is encased air-tight by a square tube on all sides, and a round pipe or flow channel Kl extends from one of two opposite sides of the unit to at least the middle of body 6, and at the same time to the middle of the application region (the exit width or working width). The applied substance or the cleaning fluid is fed to channel K1 through the connection piece 23 (in FIG. 4). If this round pipe projects through the body 6 to the end thereof, such round pipe can act as wing spar, both ends of which act on an advantageously tiltable carriage (not shown). Alternatively, such function can be achieved by the square tube.

An air-tight perpendicular wall can be installed in the middle area of the round pipe, whereby the inside area of the pipe is divided into two exact or approximately equally large flow areas. Thus, applied substance can be fed during printing to one end, and cleaning fluid can be fed to the other end during washing in alternating fashion. The substance is fed over the path K1-K2-K3, etc., through the equipment, and the cleaning fluid is fed on the other side through channel K1' into channel K2' (pipeline 7) and exits this channel through nozzles 19', preferably in a line of narrowly aligned holes of equal diameter—for the purpose of cleaning of the inside of the wall 11 and of any existing back-fill element in the application area.

In the embodiment of FIG. 2*a*, the flow channel distribution system is carried out with 13 distribution steps, which corresponds to a very large working width. The exit holes are illustrated by K13. The substance flows with very low pressure out of the openings K13, following the force of gravity, in a vertical flow direction 18' to the point of application or to application by the back-fill element, which can be a back-fill roller or a back-fill wiper or a slotted wiper, as shown in FIG. 2*a*.

Figures 2B, 2C:
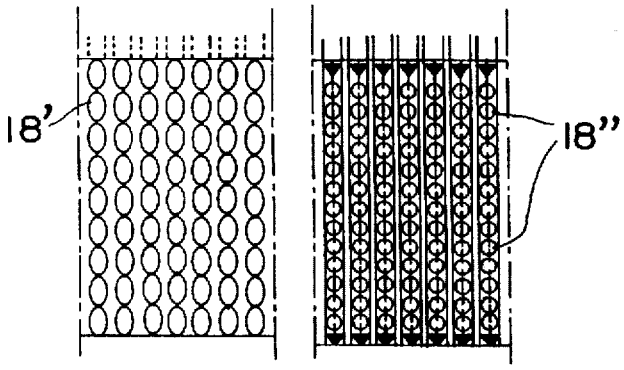
FIGS. 2*b* and 2*c* are views in the direction of arrow A of FIG. 2*a* during application of substance and supply of cleaning fluid, respectively.

During the cleaning procedure, the cleaning fluid exits from the nozzles K13 under relatively high pressure in direction 18", which corresponds to the axis of the exit nozzles K13 and effects the cleaning of the template after and in addition to the interior cleaning of the body 6. Detail views in the direction of arrow A in FIG. 2*a* are shown in FIG. 2*b* and 2*c* and represent schematically a view of 18' during the outflow of the substance, and a view of the cleaning fluid 18" exiting the holes K13 under pressure on the flow path during template cleaning, respectively. The shaded additional flow body identified by 6'" represents an embodiment per the invention through which the relatively widely distanced discharge area K13 is transferred to a discharge area K13' close to the template.

The template 1 touches the conveyor, for example, or the printer's blanket 22, or for example a roll 4 or an overlay 28, 29 thereon, or the like (FIGS. 5*a* and 5*b*), during the application procedure and also during at least a portion of the cleaning procedure.

Figure 3A:
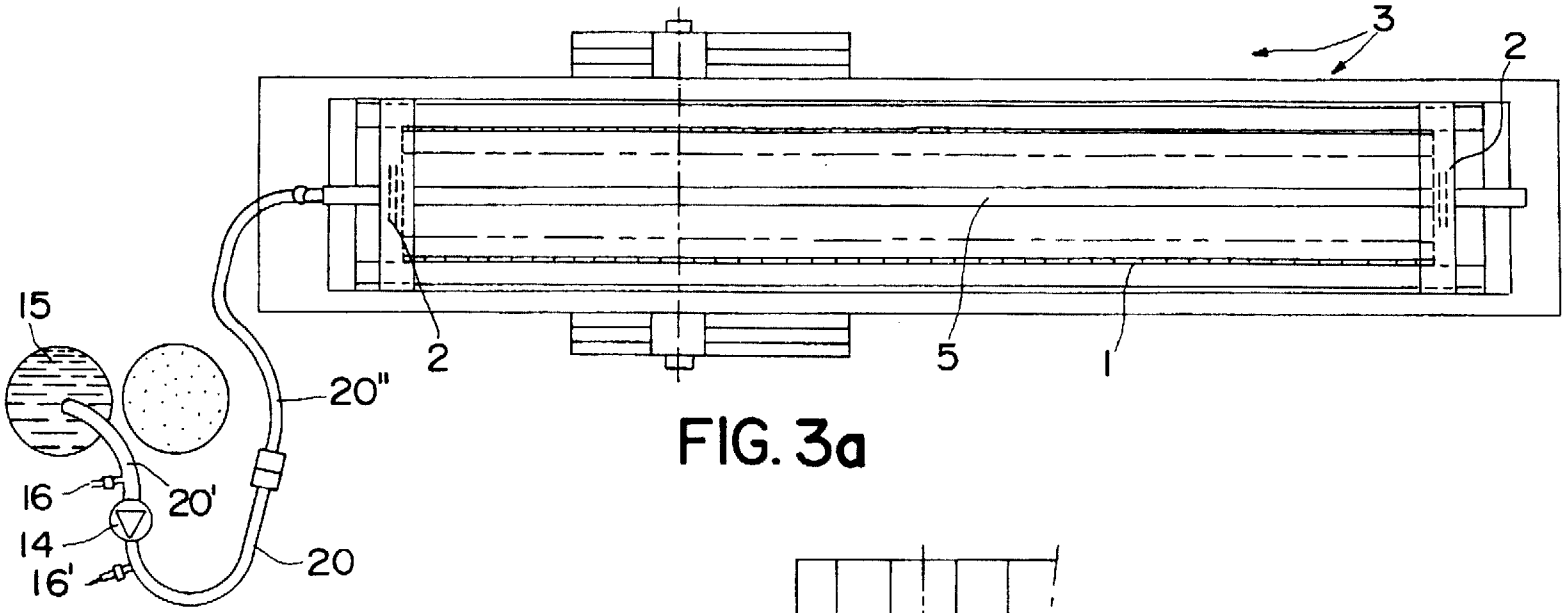
FIGS. 3*a* and 3*b* are a plan view and a partial view illustrating features of another process according to the present invention.
Figure 3B:
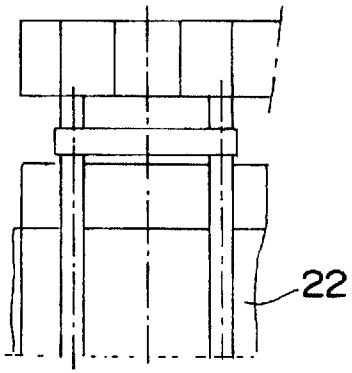

FIG. 3*a* shows a process variation per the invention of the cleaning of a printing unit. Round template 1 with end rings 2 held in position is stretched and driven as in the printing machine and is built into the application equipment per the invention. FIG. 3*b* shows a detail of the printing machine after the printing equipment is removed and placed into a washing machine per the invention.

In a variation of the process per the invention the process step according to FIG. 1*d* and also that according to FIG. 1*a* as necessary is carried out outside of the production equipment in the washing machine represented in FIG. 3*a*. The round template 1 is removed from the printer's blanket 22 together with the application unit 5 per the invention and is placed into the washing machine. The same pump 14 can be used for cleaning of the round template 1 as was used during the production procedure and for the reverse suction of excess substance according to FIG. 1*b*. Also, yet another water connection can be chosen. As required, additionally or selectively, compressed air can also be fed through one of the connectors 16, 16' in this fluid guiding feed system. This variation has the advantage that in the process of cleaning the template 1 not only the application unit 5, but also the pump 14 and connecting tubes 20, 20' are cleaned.

Figure 4:
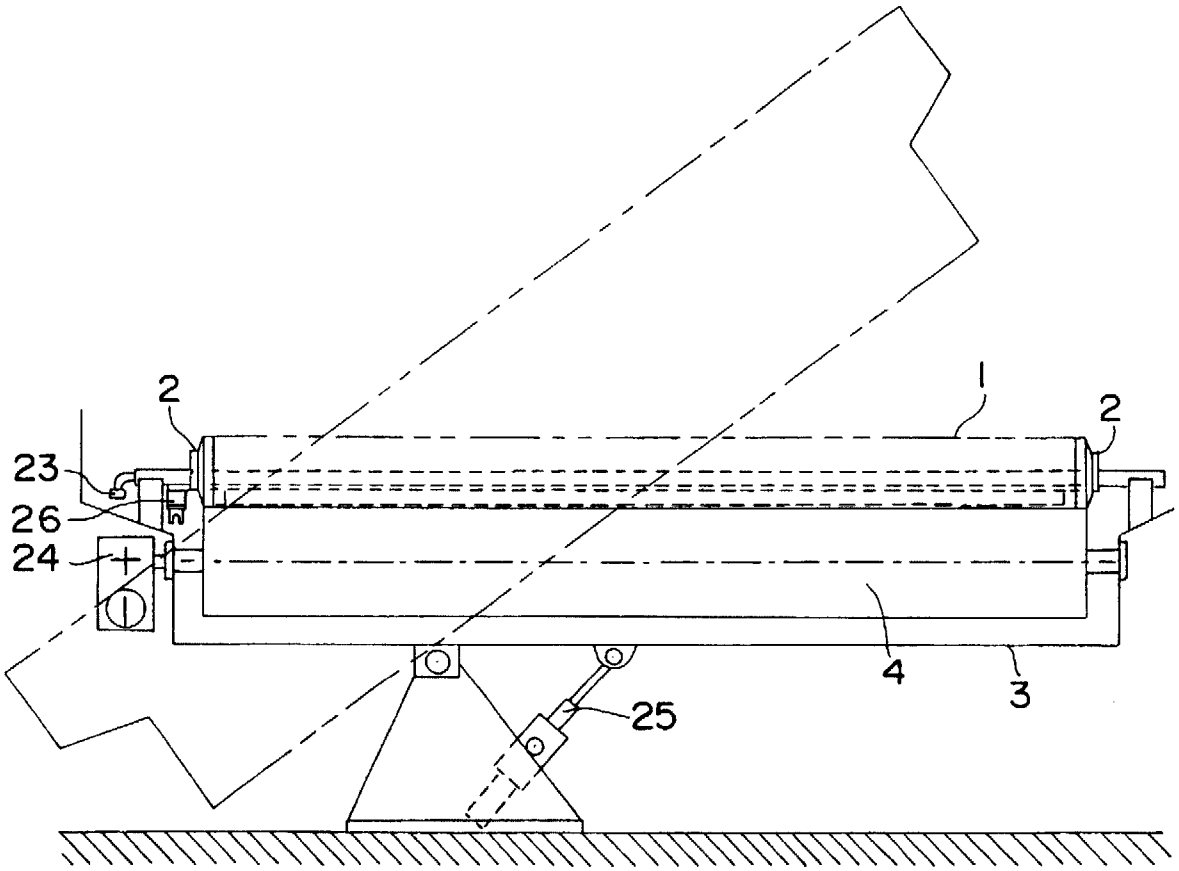
FIG. 4 is a side view illustrating an apparatus employed in the process shown in FIG. 3*a*.

FIG. 4 shows the washing equipment 3 in a schematic side view. The details of the mounting of the end rings 2, the template 1, a motor 24, cleaning roll 4, tilting equipment 25, etc., are not illustrated in detail since these details are well known, e.g. as shown in AT 360 949 (Johannes Zimmer). The only equipment features specifically illustrated are those that are novel in connection with the present invention. A magnetically attachable back-fill roll 8 belonging to the application equipment 5 may be rolled continuously or intermittently on the inside of the round template 1 during the cleaning procedure. For this purpose, an electromagnet or a permanent magnet 27 can be provided inside the roll 4 to guide the back-fill roll 8 from a rest position maintained by a permanent magnet 9 to the working position seen in FIG. 5*b*. During the cleaning procedure, the roll 4 rotates and drives the round template 1 fastened in mounting 17 by means of its end rings. Such driving can also be accomplished separately. Simultaneously, cleaning fluid is fed through the applied substance distribution system 6 and through the additionally provided fluid supply line 7. In this way, the application unit 5, the back-fill roll 8, and the interior of the round template 1 are cleaned. The exterior cleaning of the round template 1 is accomplished for example by contact with a suction overlay 28 suited for cleaning (FIG. 5*a*) or according to the variation of FIG. 5*b* by means of a brush 29 surrounding the roll 4. Also possible is a rubber overlay.

Figure 5A:
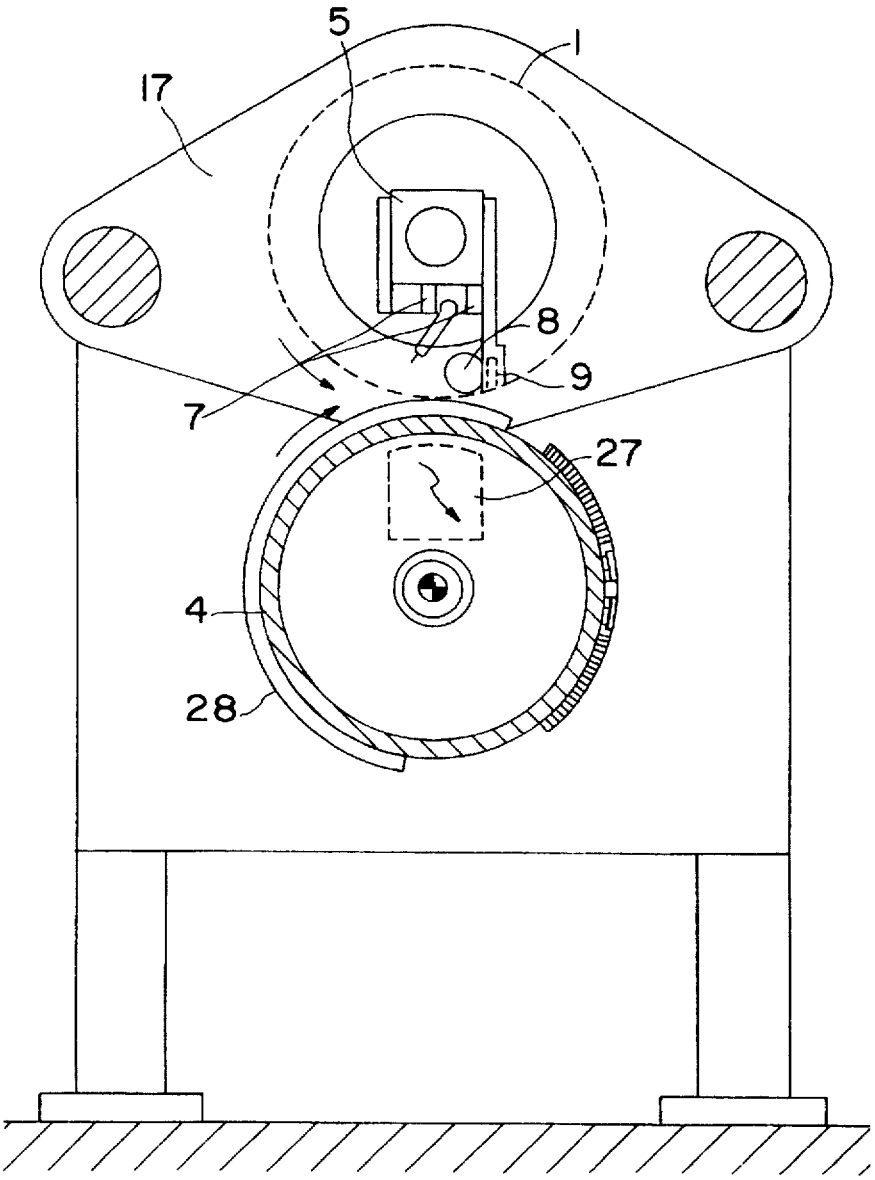
FIGS. 5*a* and 5*b* are schematic end views illustrating two embodiments of a magnetic apparatus employed in the process of FIG. 3*a*.
Figure 5B:
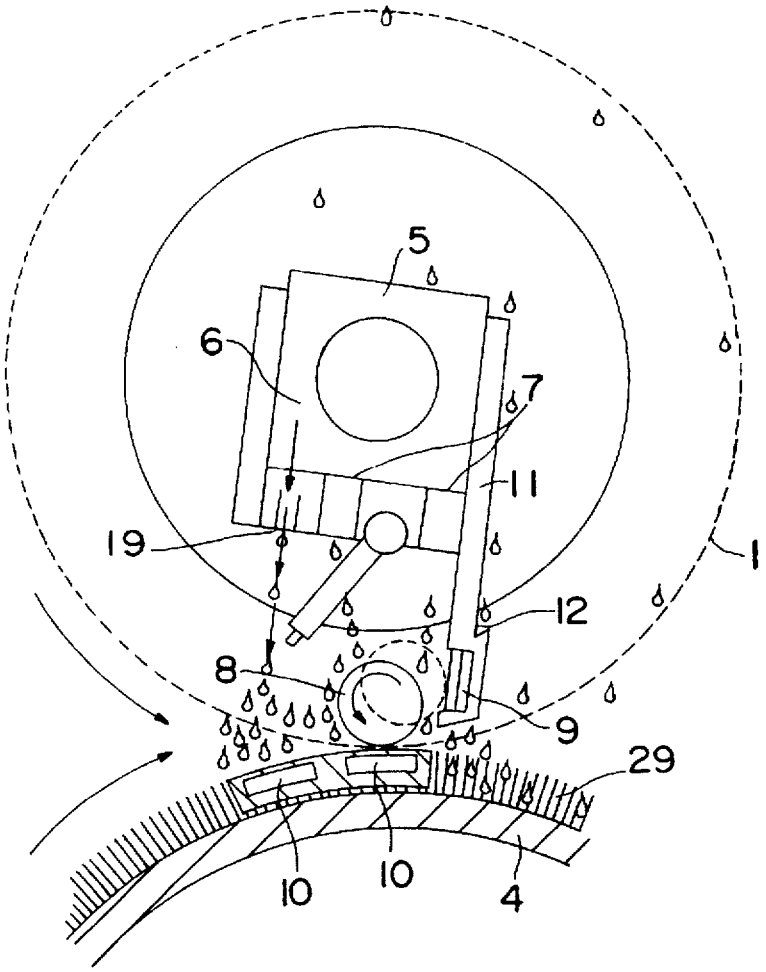

The embodiment of FIG. 5*b* is different from that of FIG. 5*a* essentially in that the attachment of the back-fill roll 8 is accomplished, not through an electromagnet or permanent magnet 27 inside the roll used in relation to one another, but rather through, for example, two permanent magnets 10 built into the surface of the roll 4 or the brush 29.

It is above all notable concerning the equipment in FIG. 5*a* and FIG. 5*b*, that the distance of the nozzles 19 of the distribution system 6 for the substance can be optimized in the area of 5–20 mm such that on the one hand a homogeneous width distribution of the substance is accomplished, on the other hand an outstanding cleaning effect in the inner cleaning of the round template 1 is accomplished. The additionally fed cleaning fluid over system 7 has the task above all of cleaning the backfill roll 8 and the support ledge or wall 11.

By addition of compressed air, the application equipment is dried in its interior areas, not only on the outer surface. If the application equipment is employed subsequently after cleaning for a new application procedure without removing the template, dripping water or cleaning fluid from run-off from the equipment rear wall 11 can cause application errors. In order to avoid this, the rear wall 11 is provided with a small rim 12 in which fluid drops remaining on the upper and rear equipment surfaces after the cleaning procedure and which run down by gravity can be collected. This measure avoids application errors by retaining fluid which otherwise would drop onto the template.

Figure 6A:
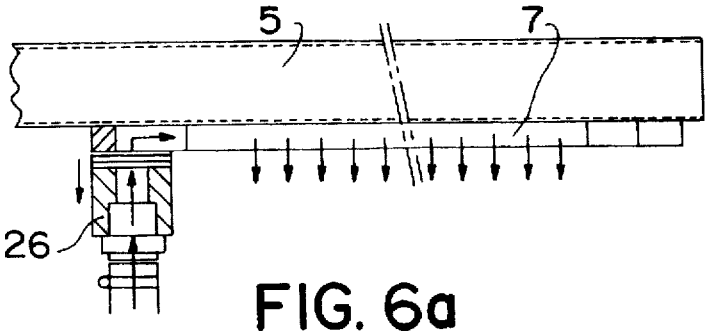
FIGS. 6*a* and 6*b* are partial schematic views illustrating supply of cleaning fluid to an application device in accordance with the present invention.
Figure 6B:
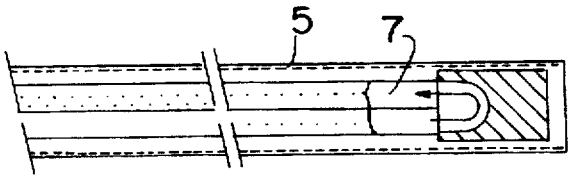

FIG. 6*a* shows details of a connector 26 shown only in FIG. 4 for the supply line 7 located on the lower side of the application unit 5 for cleaning fluid. This can consist according to FIG. 6*b* of tubes connected to one another on one end for flow, whereby a few variations of the discharge holes arranged in a row are represented; a row of holes in only one of the two tubes, only one row of holes in both tubes or none in one tube and two rows of holes arranged next to each other in the second tube.

I claim:

1. A self-cleanable apparatus for the application of a substance to a fabric train, said apparatus comprising:

a template;

an application device including a tubular body positioned to extend along said template at a location spaced therefrom;

said tubular body including an inlet adapted to be connected alternatively to a source of the substance or to a source of cleaning fluid, an interior through which the substance or cleaning fluid is passable, and a plurality of discharge holes having respective discharge axes;

said discharge holes being arranged with said discharge axes extending parallel to each other and spaced in a direction parallel to said template at intervals of 5–20 mm between adjacent said axes, and said discharge holes being spaced from said template such that the substance or the cleaning fluid passes from said discharge holes directly to said template; and said discharge holes having a total cross sectional area that is at least twice a cross sectional area of said inlet of said tubular body.

2. An apparatus as claimed in claim 1, wherein said template comprises a cylindrical template, and said application device is supported within said cylindrical template.

3. An apparatus as claimed in claim 1, wherein said interior of said tubular body is divided into plural stages through which passes in succession the substance or the cleaning fluid.

4. An apparatus as claimed in claim 1, wherein said application device further includes an outer rim operable to collect cleaning fluid.

5. An apparatus as claimed in claim 1, wherein outlets of said discharge holes are spaced a uniform distance from said template such that, upon relative movement between said template and said application device, a uniform supply of the substance can be distributed on said template.

6. An apparatus as claimed in claim 1, wherein said application device further comprises a hose assembly connectable to said inlet of said tubular body and including a pump to enable substance or cleaning fluid to be pumped into said tubular body.

7. An apparatus as claimed in claim 6, wherein said pump is reversible to enable substance or cleaning fluid to be pumped from said tubular body.

8. An apparatus as claimed in claim 1, further comprising a washing apparatus operable to receive and support said template and said application device during washing thereof.

9. An apparatus as claimed in claim 8, wherein said template is cylindrical and has opposite end rings, and said washing apparatus includes a mounting operable to support said end rings.

10. An apparatus as claimed in claim 8, wherein said washing apparatus includes a cleaning roll operable to be rotated in contact with an outer surface of said template.

11. An apparatus as claimed in claim 10, further comprising a magnetically activated roll positioned at a surface of said template opposite said cleaning roll, and a magnet positioned to urge said magnetically activated roll toward said cleaning roll and said template.

12. An apparatus as claimed in claim 11, wherein said magnet comprises a permanent magnet or electromagnet positioned inside said cleaning roll.

13. An apparatus as claimed in claim 11, wherein said magnet comprises at lest one permanent magnet built into a surface of said cleaning roll or a brush thereon.

14. An apparatus as claimed in claim 8, wherein said washing apparatus includes a connector operable to be connected to said inlet of said tubular body to enable washing fluid to be supplied thereto.

15. An apparatus as claimed in claim 14, wherein said plurality of discharge holes are formed in a supply line including two tubes positioned substantially parallel and having adjacent first ends connected together for flow communication therebetween.

16. An apparatus as claimed in claim 1, wherein said interval is 5–15 mm.

* * * * *